US005189269A

United States Patent [19]

Stahly

[11] Patent Number: 5,189,269

[45] Date of Patent: Feb. 23, 1993

[54] FLUID PRESSURE SWITCH HAVING A BELLEVILLE WASHER

[75] Inventor: Daniel C. Stahly, Elmhurst, Ill.

[73] Assignee: Eaton Corporation, Cleveland, Ohio

[21] Appl. No.: 866,600

[22] Filed: Apr. 10, 1992

[51] Int. Cl.[5] ..... H01H 35/34

[52] U.S. Cl. ..... 200/83 P; 92/103 M; 200/835; 337/320

[58] Field of Search ..... 307/118; 340/626; 91/1; 92/5 R, 101, 103 M; 73/861.47, 717, 723; 337/117, 319, 320, 343; 200/83 DR, 83 P, 83 J, 83 S, 83 SA, 406, 445

[56] References Cited

U.S. PATENT DOCUMENTS

| | | | |
|---|---|---|---|
| 4,200,776 | 4/1980 | Poling | 200/83 P |
| 4,214,137 | 7/1980 | Hartly | 200/83 P |
| 4,330,695 | 5/1982 | Poling | 200/83 P |
| 4,388,504 | 6/1983 | Hruda et al. | 200/76 |
| 4,757,165 | 7/1988 | Marcoux et al. | 200/83 P |
| 4,794,214 | 12/1988 | Sanford | 200/83 P |
| 4,820,890 | 4/1989 | Tamura et al. | 200/81.4 |
| 4,891,479 | 1/1990 | Davis et al. | 200/81 R |
| 4,939,321 | 7/1990 | Tanaka | 200/83 P |

OTHER PUBLICATIONS

"Snap-Action . . . Control", Carl Sanford, Texas Instruments, paper #860472, pp. 59-69, SAE.

*Primary Examiner*—Gerald P. Tolin

*Attorney, Agent, or Firm*—R. A. Johnston

[57] ABSTRACT

A resilient diaphragm operated pressure switch has a Belleville spring washer with a dished spring disc nested in the center and supported on the inner periphery of the washer resisting movement of the diaphragm. An actuator member is spring biased against the disc and has one end of a toggle spring registered thereon with the other end connected to a movable switch contact blade initially in an open-circuit condition. Upon the diaphragm initially experiencing increasing pressure to a first level, the actuator of the dished disc reverses curvature and moves the actuator to effect movement of the contact blade to a closed circuit condition. Upon further pressure increase to a second level, the Belleville washer snaps over-center and causes further movement of the actuator in the same direction and causes the toggle spring to snap over-center and return the contact blade member to the open-circuit condition. Upon decreasing pressure to a third level between the first and second levels, the Belleville washer again snaps over-center and retracts the actuator and causes the toggle spring to go over-center and move the contact blade again to closed circuit condition. Upon further pressure decrease to a fourth level less than the first level, the dished disc snaps back and retracts the actuator sufficiently to cause the toggle spring to allow the control blade to return to the initial open-circuit condition.

9 Claims, 2 Drawing Sheets

FLUID PRESSURE SWITCH HAVING A BELLEVILLE WASHER

BACKGROUND OF THE INVENTION

The present invention relates to pressure switches and particularly pressure switches of the type wherein the switch exhibits make-before-break characteristics on increasing pressure and also make-before-break actuation characteristics upon decreasing pressure. Switches having this type of actuation characteristics find application in automotive air conditioning systems where it is desired to control the energization and de-energization of the refrigerant compressor clutch in response to changes in the pressure of the vaporized refrigerant circulating in the system.

Typically, automotive air conditioning system pressure switches employ a pressure-responsive diaphragm acting against a movable piston to provide the necessary actuating force for operation of the electrical switch mechanism to control the compressor clutch. However, it has been found in pressure switches of this type that the required movement of the piston produces undesirable amounts of movement of the diaphragm in the boundary regions thereof. This movement has ultimately resulted in fatigue failure of the diaphragm and reduced service life of the pressure switch.

It has thus been desired to find a way or means of controlling the movement of a pressure-responsive diaphragm in a pressure switch in a manner that will produce long service life in terms of number of cycles of the switch and yet provide the desired make-before-break binary type actuation of the switch over a broad range of sensed pressures. It has also been desired to devise such a binary action pressure switch which has a minimum of parts or components and lends itself to high volume mass production techniques and has a resultant low manufacturing cost.

SUMMARY OF THE INVENTION

The present invention provides a diaphragm operated make-before-break or binary actuation type pressure switch with movement of a pressure-responsive diaphragm resisted in part by a Belleville washer disposed about the periphery of the diaphragm. A relatively thin dished snap-acting disc is mounted at its outer periphery about the inner periphery of the Belleville washer and resists movement of the central region of the diaphragm. The dished disc bear against an actuator member having one end of a snap-acting toggle spring registered thereon with the opposite end of the toggle spring connected to a movable switch contact blade member for effecting actuation and de-actuation of the contact blade member against a stationary contact. The actuator member is biased into contact with the dished disc by a second spring.

Upon increasing pressure at the pressure switch inlet or sensing port, the forces of the pressure acting on the diaphragm at a first pressure level cause the dished disc to snap over-center. The snap movement of the disc moves the actuator member, causing the toggle spring to move a slight amount to effect closing of the movable contact blade against the stationary contact without yet effecting a snap actuation.

Upon further increases in pressure to a second preselected level, the forces of the pressure acting on the diaphragm cause the Belleville washer to snap over-center and move the actuator member further in the same direction a sufficient amount to move the end of the toggle spring over-center and effect a reverse snap action of the movable contact blade member to the open switch condition.

Upon decreasing pressure from the second preselected level, the Belleville washer is caused to again go over-center in the reverse direction at a third pressure level slightly below the second level, permitting the actuator member to return the end of the toggle spring to a preposition, causing the toggle spring to again snap the movable contact blade member to the closed circuit condition against the stationary contact. Upon further pressure decreases from the third level, the dished disc is again snapped to its initial position by the force of the second spring biasing the actuator member thereagainst; and, the toggle spring is lifted to a position permitting the movable contact blade member to again go open-circuit with respect to the stationary contact.

The nested dished disc on a Belleville spring-type spring resistance against movement of the pressure-responsive diaphragm provides the pressure switch of the present invention with a unique binary or make-before-break actuation with a minimum of parts and a minimum of movement of the pressure-responsive diaphragm. The unique construction of the present pressure switch provides long service-cycle life of the diaphragm and enables low-cost manufacturing of the switch assembly from a minimum of parts.

DETAILED DESCRIPTION

Figure 1:
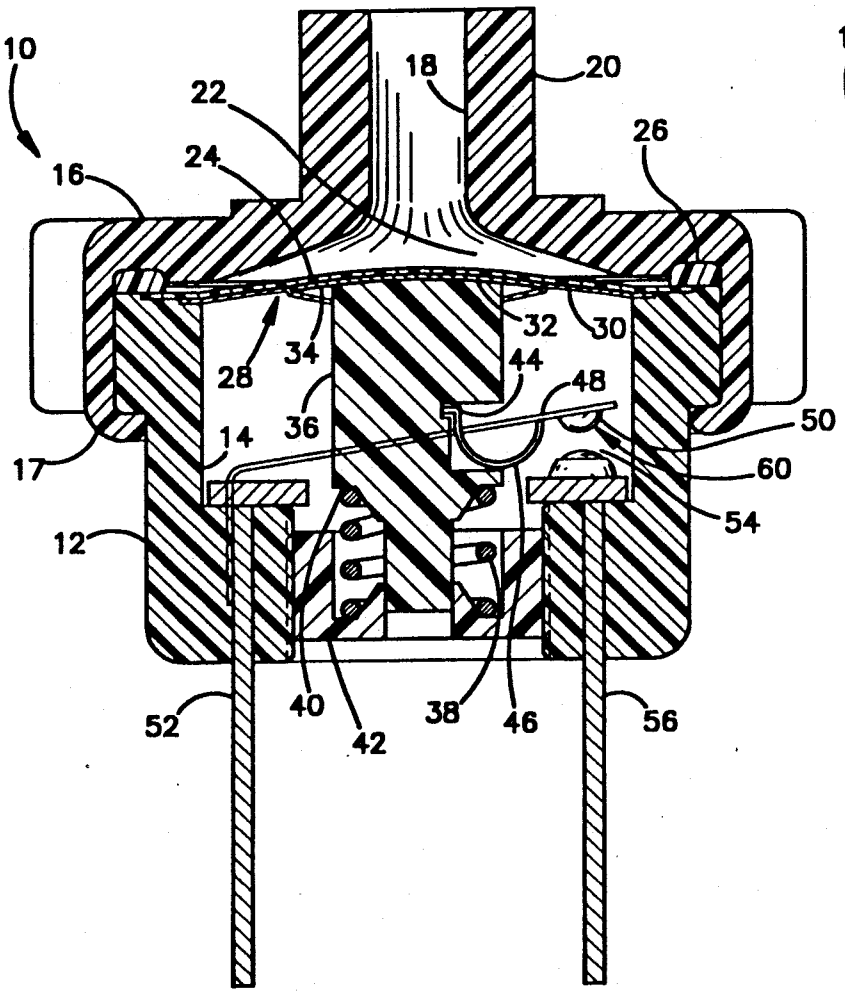
FIG. 1 is a cross-section of the pressure switch assembly of the present invention in the initial condition with no pressure signal applied to the inlet port.

Referring to FIG. 1, the pressure switch of the present invention is indicated generally at 10 as having a body or base 12 and has a switching cavity 14 formed therein. A housing or cover member 17 is secured over the base 12 by any suitable expedient as, for example, the inwardly turned edge 16, which may be formed to provide a snap-lock engagement if desired.

Housing 16 has an inlet port 18 provided in boss 20 formed thereon. A pressure-sensing cavity 22 is formed in the housing 16 and has a pressure-responsive diaphragm 24 sealed about its periphery by seal ring 26 compressed thereagainst by housing 16 upon assembly of the housing over the base 12.

Diaphragm 24 has registered thereagainst on the under side thereof a resiliently deformable spring assembly indicated generally at 28 which resists downward movement of the diaphragm upon application of a pressure signal to port 18 and cavity 22.

Spring assembly 28 comprises an annular, preferably conically tapered relatively thin spring member or Belleville washer 40 registered at its outer periphery in a groove formed in the base 12. Spring washer 30 in its initial configuration is tapered in an upward direction as illustrated in FIG. 1. The Belleville spring washer 30 has a ledge or shoulder 32 formed about the inner periphery thereof which shoulder 32 has registered thereagainst the outer periphery of a dished, relatively thin disc spring member 34 which has the concave surface thereof disposed downwardly as shown in FIG. 1.

A movable actuator member 36 has the upper end thereof registered against the undersurface of disc 34; and, is biased thereagainst by a second spring 38 which has its upper end registered against a shoulder 40 formed on the actuator member. The lower end of spring 38 is registered against the inner surface of an adjustable rotatable plug 42 which is threadedly received in the base 12.

The actuator member 36 has a notch provided in the side thereof into which is received one end 44 of a bowed toggle spring 46 which has its other end connected to a movable blade member 48. Blade member 48 has movable electrical contact 50 mounted thereon and has the opposite end thereof anchored in electrical connection with a terminal 52 which has one end thereof extending outwardly through base 12 and which is adapted for external electrical connection thereto.

A stationary contact 54 is disposed directly beneath contact 50; and, the contact 54 is electrically connected to a terminal 56, which also extends outwardly from the base 12 and is adapted for external electrical connection thereto.

Referring to FIG. 1, the switching mechanism indicated generally at 60 is shown in the unpressurized state and the unactuated or open-circuit condition with contact 50 separated from contact 54 break the circuit between terminal 52 and terminal 56.

It will be understood that the movable contact blade 48 may be bifurcated to permit the actuator 36 to pass between parallel legs thereof; or, the actuator 36 may be slotted to permit the blade member 48 to pass therethrough. In the presently preferred practice of the invention, the movable contact blade member 48 is bifurcated to permit the actuator member 36 to pass between parallel portions thereof, only one of which is illustrated in the drawings and which parallel portions are anchored commonly to terminal 52.

Figure 2:
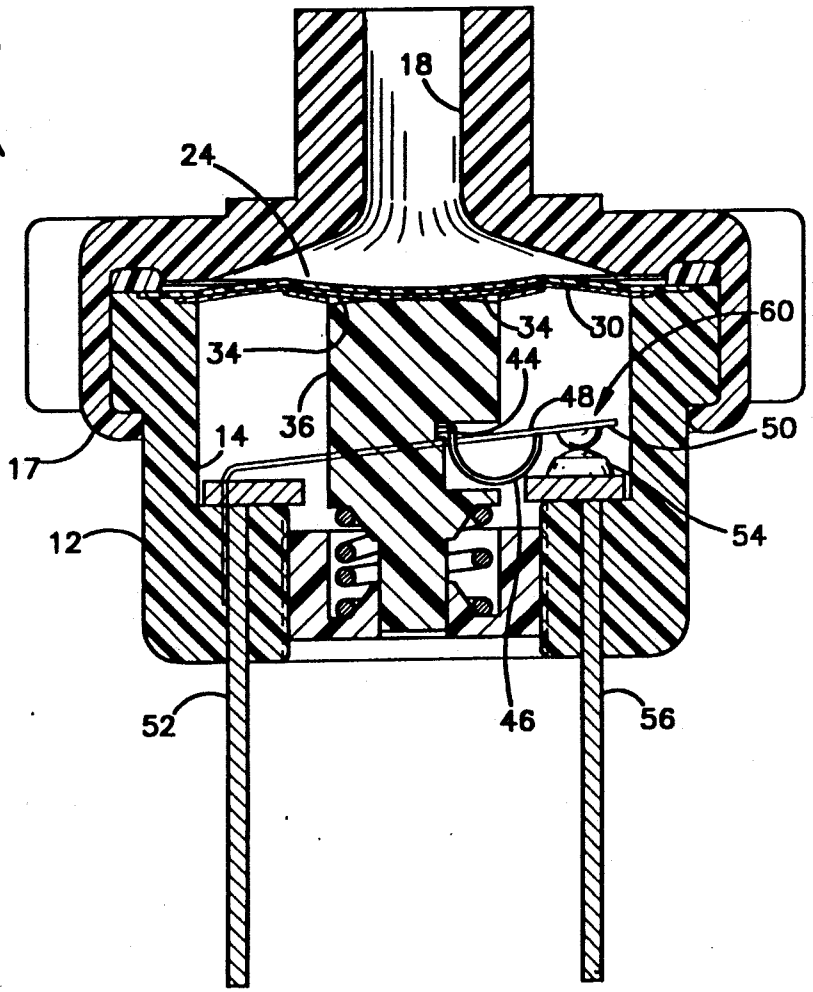
FIG. 2 is a view similar to FIG. 1 with the switch pressurized to a first predetermined pressure signal at the inlet port.

Referring to FIG. 2, the pressure switch 10 is shown in the condition with the switch means 60 in the actuated or closed circuit condition to complete a circuit between terminals 52 and 56 with contact 50 closed against contact 54. In the condition illustrated in FIG. 2, a fluid pressure signal corresponding to level A in FIG. 4*a* has been applied to inlet port 18 sufficient to cause the forces acting over the diaphragm 24 in the central region thereof to deflect the dished disc 34 in a snap action over-center to the concave upward configuration illustrated in FIG. 2. In this snapped concave upward condition, the disc 34 has moved the actuator member 36 downward and lowered the end 44 of the bowed spring 46 an amount sufficient to move contact blade member 48 to the downward position illustrated in FIG. 2. It will be understood that the end 44 of the toggle spring 46 remains above the actuator member 48 and does not go over-center in the condition of FIG. 2 and provides a downward bias on the actuator member 48 to maintain contact 50 firmly closed against the stationary contact 54.

Figure 4A:
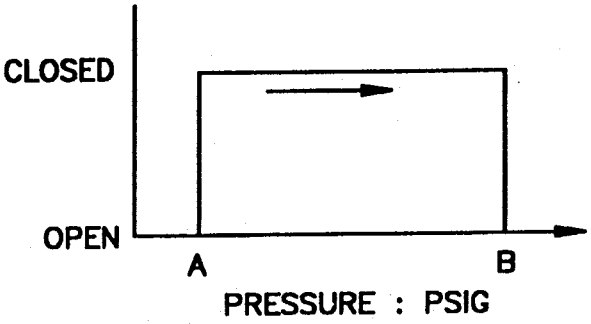
FIG. 4*a* is a graphical description of the switch actuation on increasing pressure; and, FIG. 4*b* is a view similar to FIG. 4*a* with switch actuation on decreasing pressure.
Figure 3:
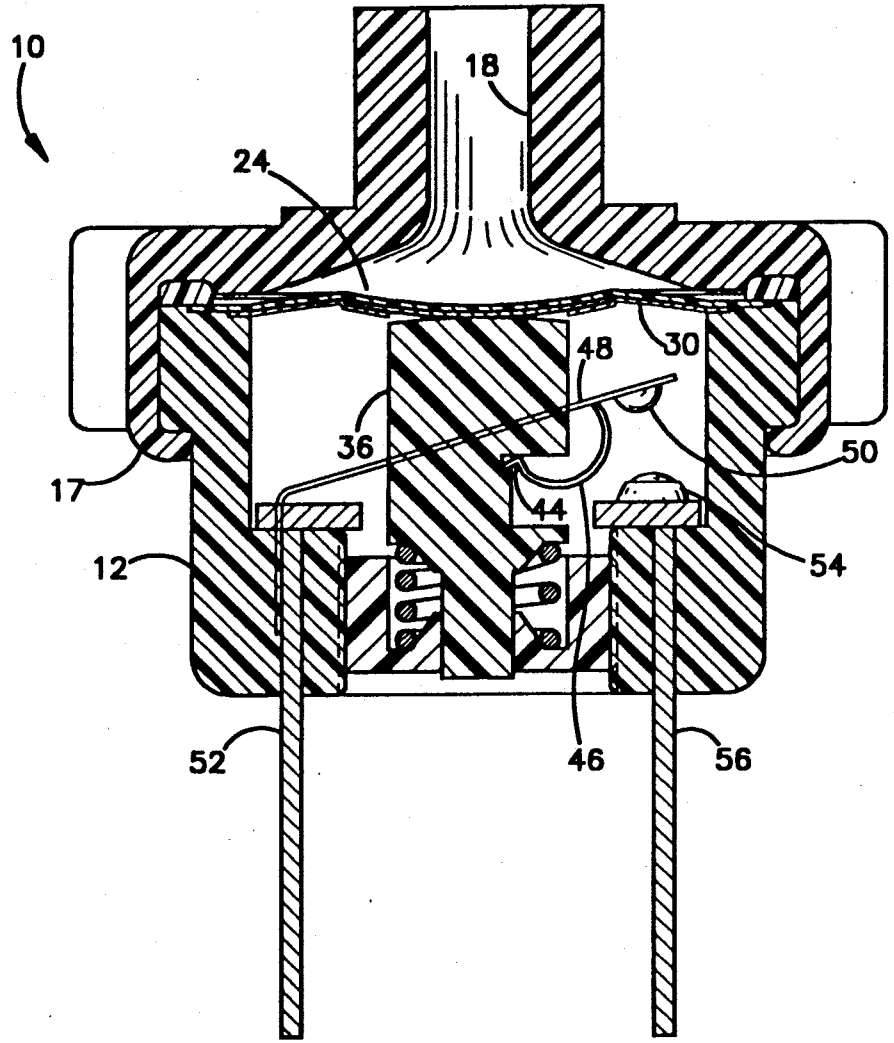
FIG. 3 is a view similar to FIG. 1 showing the pressure switch pressurized to a second higher level of pressurization at the inlet port.

Referring to FIG. 3, the pressure switch 10 is illustrated in the condition wherein the pressure at inlet 18 has been raised to a second preselected level identified by reference character B in FIG. 4*a* in which the Belleville washer has snapped over-center or downwardly under the urging of the pressure forces acting over the diaphragm 24. In the pressurized condition, denoted at point B in FIG. 4*a* and as shown in FIG. 3, the switch actuator member 36 has been moved downwardly and in the same direction of movement as in FIG. 2 by an additional amount such that the end 44 of toggle spring 46 has been moved downwardly between the unshown bifurcated portions and below contact blade 48. When the end 44 of spring 46 is moved past blade 48, this causes movement of the contact blade 48 upwardly with a snap action to the position shown in FIG. 3, breaking contact between movable contact 50 and stationary contact 54 and opening of the circuit between terminals 52 and 56.

Figure 4B:
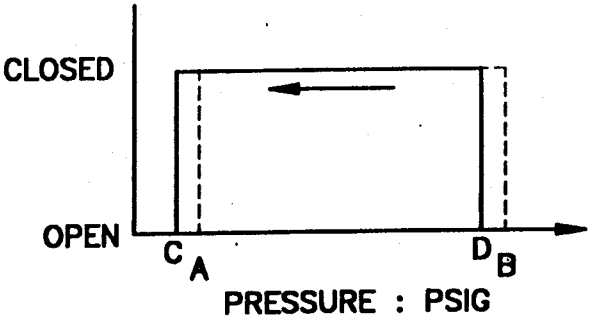

As the pressure in the port 18 is decreased from that denoted by level B in FIG. 4*a*, to a level intermediate level B and level A as denoted by reference character C in FIG. 4*b*, the Belleville toggle spring 30 is again snapped upward to have the configuration as shown in FIG. 2 allowing the actuator member 36 to again move upward and allows move end 44 toggle spring 44 again above contact blade 48, which results in snap-action reclosing of the switch 60 to the condition shown in FIG. 2.

As the pressure is further decreased below level C to a level denoted by reference character D in FIG. 4*b*, which is slightly below the level A of FIG. 4*a*, the dished disc 34 is permitted to snap back to the upwardly concave position shown in FIG. 1, thereby permitting spring 38 to move actuator 36 upwardly, permitting end 44 of the bowed spring 46 to allow contact blade member 48 to again move upwardly to the open-circuit condition shown in FIG. 1. This condition is illustrated by reference character D in FIG. 4*b*.

The present invention thus provides a unique simplified construction for a binary or make-before-break pressure switch employing a nested disc in a Belleville washer which gives staggered snap action to the switch on increasing and decreasing pressure. The pressure switch of the present invention thus provides a minimum of movement to the pressure responsive resilient diaphragm and thus improves the service life of the pressure switch.

Although the invention has been hereinabove described with respect to the illustrated embodiments, it will be understood by those having ordinary skill in the art that the invention is capable of modification and variation, and is intended as limited only by the following claims.

I claim:

1. A pressure switch assembly comprising:

(a) body means defining fluid pressure signal port and a fluid pressure sensing cavity;

(b) pressure-responsive means forming a portion of the boundary of said cavity and movable in response to pressure changes in said cavity;

(c) bias means disposed on one side of said pressure-responsive means and resisting movement thereof, said bias means including (i) a Belleville washer supported at its outer periphery on said body means, (ii) a convexo-concave disc having the outer periphery thereof supported on the inner periphery of said Belleville washer, wherein upon increasing pressure on said pressure-responsive means, said disc undergoes snap-acting reverse curvature movement at a first pressure level and said Belleville washer goes over-center with a snap-action at a second pressure level higher than said first level; and, (d) switch means including actuator means operably moved by said disc for actuation and de-actuation.

2. The assembly defined in claim 1, wherein said Belleville washer has an offset formed about the inner periphery thereof with said disc registered in said offset.

3. The assembly defined in claim 1, wherein said disc has a convexo-concave configuration.

4. A pressure switch assembly comprising:

(a) body means defining a fluid pressure signal port and a fluid pressure sensing cavity communicating with said port;

(b) a pressure-responsive diaphragm forming a portion of the boundary of said cavity;

(c) spring means resiliently opposing movement of said diaphragm with increasing pressure in said cavity, said spring means including;

(i) an annular axially inclined member resiliently supported on said body means about its outer periphery, said annular member also having an inner periphery, (ii) a dished disc having its outer periphery supported on the inner periphery of said annular member, said disc operable to resist movement of said diaphragm by resilient deflection thereof, said disc further capable to reach deflection instability and reverse curvature at a force level corresponding to a first preselected pressure acting on said diaphragm, said annular member operable to reach deflection instability and effect an over-center movement at a load corresponding to a second preselected pressure higher than first pressure acting on said diaphragm; and, (d) switch means, including an actuator operable in response to movement of said disc, said switch means in the open-circuit condition upon said cavity experiencing atmospheric pressure and upon said port and said cavity experiencing a first preselected level of pressure signal said switch actuator being moved by snap action of said disc to actuation of said switch means to the closed circuit condition and upon further increase in said pressure signal to a second preselected level significantly greater than said first level said annular tapered member snaps over-center and further moves said actuator member causing said switch means to again go to open-circuit condition.

5. The pressure with assembly defined in claim 4, wherein said switch means has a snap action mechanism.

6. The pressure switch assembly defined in claim 4, wherein said switch means is operative upon said port and said cavity experiencing a decreasing pressure signal from said second preselected level to a third level significantly less than said second level and greater than said first level to again go to a closed circuit condition, and upon further decreasing of said pressure signal to a fourth preselected level less than said first level, said switch means returns to the open-circuit condition.

7. The pressure switch assembly defined in claim 4, wherein said switch means has a snap action between said first and second level of said pressure signal.

8. The pressure switch assembly defined in claim 4, wherein said annular axially inclined member has an annular shoulder formed about the inner periphery thereof with said disc registered thereon.

9. A pressure switch comprising:

(a) body means defining a pressure-sensing cavity having a pressure signal port therein and a resilient diaphragm movable in response to pressure changes in said cavity;

(b) spring means resiliently resisting movement of said diaphragm and including (i) a Belleville spring washer supported on said body means about its outer periphery, (ii) a dished spring disc having its outer periphery supported on the inner periphery of said Belleville washer;

(c) actuator means operably contacting said spring means for movement therewith; and, (d) switch means operably contacted by said actuator means for actuation and de-actuation.

* * * * *